US006548182B1

(12) United States Patent
Field et al.

(10) Patent No.: US 6,548,182 B1
(45) **Date of Patent: *Apr. 15, 2003**

(54) COATING AGENT FOR INK JET RECORDING MATERIALS AND INK JET RECORDING MATERIAL

(75) Inventors: Dana D. Field, Sarasota, FL (US); Yoshinobu Yamamoto, Suita (JP); Yoshihiro Arita, Osaka (JP); Norihiro Wakao, Suita (JP)

(73) Assignees: Esprit Chemical Co., Sarasota, FL (US); Nippon Shokubai Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/362,943

(22) Filed: Jul. 28, 1999

Related U.S. Application Data

(60) Provisional application No. 60/095,245, filed on Aug. 4, 1998.

(51) Int. Cl.[7] ..... B41M 5/00

(52) U.S. Cl. ..... 428/500; 428/507; 524/522; 524/512; 524/507

(58) Field of Search ..... 524/522, 512, 524/507; 523/439; 428/500, 507

(56) References Cited

U.S. PATENT DOCUMENTS

| | | | | | |
|---|---|---|---|---|---|
| 4,436,789 | A | | 3/1984 | Davis et al. | |
| 4,474,847 | A | * | 10/1984 | Schroder et al. | 428/323 |
| 4,694,050 | A | | 9/1987 | Fairchok et al. | |
| 4,732,786 | A | * | 3/1988 | Patterson et al. | 428/513 |
| 4,781,978 | A | | 11/1988 | Duan | |
| 4,889,765 | A | * | 12/1989 | Walace | 428/500 |
| 4,910,268 | A | * | 3/1990 | Kobayashi | 525/411 |
| 4,956,230 | A | | 9/1990 | Edwards et al. | |
| 5,087,603 | A | * | 2/1992 | Izubayashi et al. | 503/526 |
| 5,134,198 | A | | 7/1992 | Stofko, Jr. et al. | |
| 5,153,273 | A | * | 10/1992 | Kobayashi | 525/412 |
| 5,439,739 | A | * | 8/1995 | Furukawa et al. | 428/500 |
| 5,470,908 | A | * | 11/1995 | Schmidt et al. | 524/520 |
| 5,486,854 | A | | 1/1996 | Uchida | |
| 6,120,900 | A | * | 9/2000 | Sargeant et al. | |
| 6,201,056 | B1 | * | 3/2001 | Zhu | 524/493 |
| 6,194,077 | B1 | * | 2/2002 | Yuan et al. | 428/500 |

FOREIGN PATENT DOCUMENTS

| | | |
|---|---|---|
| EP | 0 696 516 A1 | 2/1996 |
| EP | 0 709 221 A1 | 5/1996 |
| EP | 0 716 929 A1 | 6/1996 |
| EP | 0 885 432 A2 | 7/1998 |
| JP | 63-57276 A | 3/1988 |
| JP | 10-35090 A | 2/1998 |

* cited by examiner

*Primary Examiner*—D. R. Wilson
(74) *Attorney, Agent, or Firm*—Haugen Law Firm PLLP

(57) ABSTRACT

The present invention provides: an ink jet recording material which displays sufficient water resistance and further, excellent definition of initial images; and a coating agent therefor to give such an ink jet recording material. A first coating agent for ink jet recording materials, according to the present invention, comprises: an aqueous polymer having a carboxyl group; and a water-soluble polymer having an oxazoline group as a crosslinking agent. A second coating agent for ink jet recording materials, according to the present invention, comprises a polymer and a crosslinking agent, wherein the polymer has both a structural unit, as formed by ring-opening polymerization of an oxazoline compound, and a carboxyl group. An ink jet recording material, according to the present invention, has on at least one face thereof a coated and cured layer of the above present invention first coating agent and/or a coated and cured layer of the above present invention second coating agent, and displays high water resistance and excellent image quality.

2 Claims, No Drawings

COATING AGENT FOR INK JET RECORDING MATERIALS AND INK JET RECORDING MATERIAL

This application claims the benefit of U.S. Provisional Application No. 60/095,245 filed Aug. 4, 1998.

BACKGROUND OF THE INVENTION

A. Technical Field

The present invention relates to an ink jet recording material and a coating agent therefor, more particularly, relates to: an ink jet recording material which displays sufficient water resistance and further, excellent definition of initial images; and a coating agent therefor to give such an ink jet recording material.

B. Background Art

Ink jet recording apparatuses are machines such as printers, facsimile machines, and copiers. For the ink jet recording apparatus, U.S. Pat. No. 5,486,854 issued Jan. 23, 1996 is hereby incorporated by reference. The ink jet recording apparatus is to make a recording by jetting ink from a recording means (i.e. a recording head which is a part of the ink jet recording apparatus) onto a recording material, wherein the recording material is, for example, a paper sheet, or a plastic sheet such as transparent PET sheet.

The ink jet recording material, generally, suffers from a lack of water resistance. That is, an exposure to water usually will dissolve and destroy the image (the imaged ink). To prevent this, the image must be rendered water-resistant, and further, if the ink is, for example, an organic dye, then the image must also be fixed. Examples of known methods of giving the image the water resistance to thereby fix the image include arts to fix dyes with mordants and arts involving the use of adsorptive pigments. However, operations thereof are complicated, or the optimal method is different according to the composition of the ink, so the above known methods are not commonly usable means.

In comparison, JP-A-035090/1998 discloses a water-resistant composition for ink jet recording sheets, comprising a polymer containing an amino group (and/or quaternary ammonium salt) and a carboxyl group (and/or acid anhydride) and a crosslinking agent containing at least two oxazoline groups, as a method of not giving the image the water resistance, but carrying out a water-resisting pretreatment for the recording material. However, as to this technique, not only is the resultant water-resistification insufficient, but also there are problems on the definition of initial images.

SUMMARY OF THE INVENTION

A. Objects of the Invention

An object of the present invention is to provide: an ink jet recording material which displays sufficient water resistance and further, excellent definition of initial images; and a coating agent therefor to give such an ink jet recording material.

B. Disclosure of the Invention

To solve the above problems, the present invention provides the following:

A first coating agent for ink jet recording materials, according to the present invention, comprises: an aqueous polymer having a carboxyl group; and a water-soluble polymer having an oxazoline group as a crosslinking agent.

A second coating agent for ink jet recording materials, according to the present invention, comprises a polymer and a crosslinking agent, wherein the polymer has both a structural unit, as formed by ring-opening polymerization of an oxazoline compound, and a carboxyl group.

An ink jet recording material, according to the present invention, has on at least one face thereof a coated and cured layer of the above present invention first coating agent and/or a coated and cured layer of the above present invention second coating agent.

These and other objects and the advantages of the present invention will be more fully apparent from the following detailed disclosure.

DETAILED DESCRIPTION OF THE INVENTION

The first coating agent, according to the present invention, comprises: an aqueous polymer having a carboxyl group; and a water-soluble polymer having an oxazoline group as a crosslinking agent.

The aqueous polymer having a carboxyl group is not especially limited if it is a polymer that has a carboxyl group and further is aqueous (that is, water-soluble or water-dispersible). To obtain the polymer having a carboxyl group, a monomer having a carboxyl group is, for example, polymerized as a raw material, or a carboxyl group is introduced into a polymer (as prepared beforehand) by denaturation. To obtain the aqueous polymer, a hydrophilic monomer (available whether it has a carboxyl group or not) is, for example, used in the ratio of preferably 10 mol % or higher, more preferably 50 mol % or higher, to the entire monomer component.

Examples of the monomer having a carboxyl group include: unsaturated monocarboxylic acids, such as acrylic acid, methacrylic acid, and crotonic acid; unsaturated dicarboxylic acids, such as maleic acid, itaconic acid, citraconic acid, and fumaric acid; and unsaturated dicarboxylic anhydrides, such as maleic anhydride, itaconic anhydride, and citraconic anhydride.

Examples of the method, in which a carboxyl group is introduced into a polymer (as prepared beforehand) by denaturation, include a method including the step of jumping up a polymer, having an OH group in opposite terminal portions, with pyromellitic dianhydride.

Examples of the hydrophilic monomer include: monomers having a carboxyl group; and other monomers, such as hydroxyethyl acrylate, hydroxyethyl methacrylate, vinylpyrrolidone, dimethylaminoethyl acrylate, and chloridized-triaminoethyl methacrylate.

Examples of the aqueous polymer having a carboxyl group, as preferably usable in the present invention, include: polyvinyl alcohols having a carboxyl group (for example, anionic KEPS series made by Dai-ichi Kogyo Seiyaku Co., Ltd., and K Polymer made by Kuraray Co., Ltd.); (meth) acrylic ester copolymers (for example, Arolon made by Nippon Shokubai Co., Ltd.); vinyl ether-maleic anhydride copolymers (Gantrez AN series made by ISP); and aqueous polymers having both a structural unit, as formed by ring-opening polymerization of an oxazoline compound, and a carboxyl group. Particularly preferable ones are the aqueous polymers having both a structural unit, as formed by ring-opening polymerization of an oxazoline compound, and a carboxyl group.

Examples of the above aqueous polymer having both a structural unit, as formed by ring-opening polymerization of an oxazoline compound, and a carboxyl group include a polymer having a structural unit of general formula (1) below:

(1)

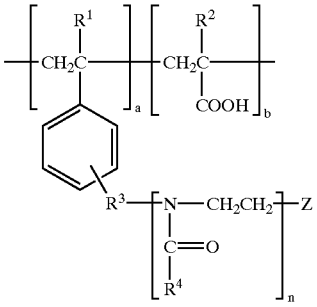

wherein: each of $R^1$ and $R^2$, independently of each other, denotes a hydrogen atom or a methyl group;

$R^3$ denotes a divalent organic residue;

$R^4$ denotes a monovalent organic residue;

Z denotes a halogen atom;

a denotes an integer of 1~1,000;

b denotes an integer of 3~110,000; and n denotes an integer of 3~5,000.

This polymer can be synthesized by carrying out cationic polymerization of an oxazoline compound in the presence of an unsaturated halide to synthesize a polyoxazoline macromonomer having a radical-polymerizable double bond at a polymerization-initiating terminal, and then copolymerizing this polyoxazoline macromonomer and a monomer having a carboxyl group, as is illustrated by the following chemical reaction formula:

wherein $R^1$, $R^2$, $R^3$, $R^4$, Z, a, b, and n are the same as those in general formula (1).

Examples of the oxazoline compound, as usable in the above cationic polymerization, include 2-methyl-2-oxazoline, 2-ethyl-2-oxazoline, 2-(n-propyl)-2-oxazoline, 2-(i-propyl)-2-oxazoline, 2-(n-butyl)-2-oxazoline, 2-(i-butyl)-2-oxazoline, and 2-(t-butyl)-2-oxazoline. Preferable ones among them are compounds with not more than 3 carbon atoms in $R^4$, of which specific examples include 2-ethyl-2-oxazoline.

Examples of the above unsaturated halide include chloromethylstyrene, allyl chloride, epichlorohydrin, and chloroethyl vinyl ether. A preferable one among them is chloromethylstyrene.

As to the monomer having a carboxyl group, compounds in which $R^2$ is a hydrogen atom or a methyl group are preferable among the above-exemplified monomers having a carboxyl group. Specific examples of such compounds include acrylic acid and methacrylic acid.

Therefore, preferable examples of the aqueous polymer having both a structural unit, as formed by ring-opening polymerization of an oxazoline compound, and a carboxyl group include poly(2-methyl-2-oxazoline)/(meth)acrylic acid copolymers, poly(2-ethyl-2-oxazoline)/(meth)acrylic acid copolymers, poly(2-(n-propyl)-2-oxazoline)/(meth) acrylic acid copolymers, poly(2-(i-propyl)-2-oxazoline)/(meth)acrylic acid copolymers, poly(2-(n-butyl)-2-oxazoline)/(meth)acrylic acid copolymers, poly(2-(i-butyl)-2-oxazoline)/(meth)acrylic acid copolymers, and poly(2-(t-butyl)-2-oxazoline)/(meth)acrylic acid copolymers.

The above aqueous polymer having both a structural unit, as formed by ring-opening polymerization of an oxazoline compound, and a carboxyl group is available whether it contains a structural unit other than the structural unit of general formula (1) above or not.

In addition, in the above general formula (1), a is an integer of 1~1,000, preferably 1~500, and b is an integer of 3~10,000, preferably 3~5,000, and n is an integer of 3~5,000, preferably 10~5,000, more preferably 2~100, still more preferably 5~500.

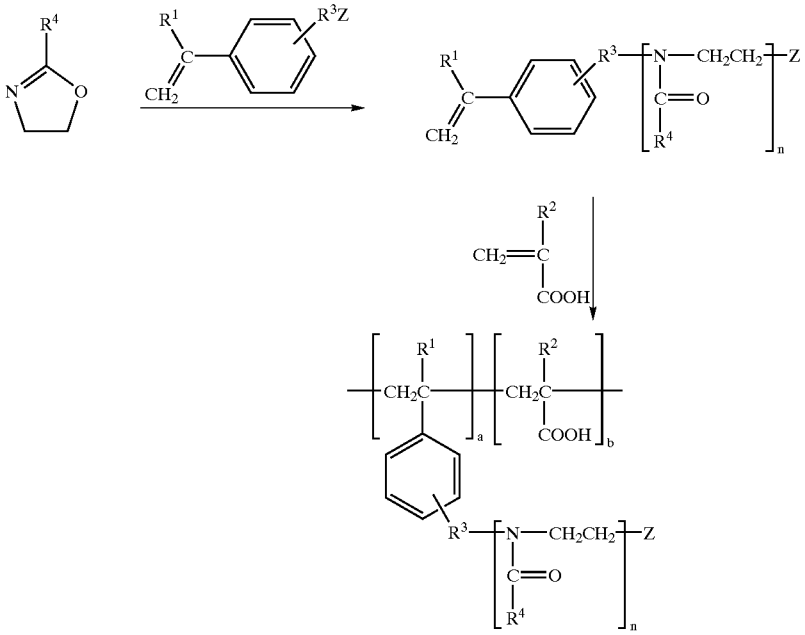

(1)

The weight-average molecular weight of the above aqueous polymer having both a structural unit, as formed by ring-opening polymerization of an oxazoline compound, and a carboxyl group is preferably in the range of 50,000~1,000,000, more preferably 100,000~500,000.

Examples of the water-soluble polymer having an oxazoline group as a crosslinking agent, as contained in the first coating agent according to the present invention, include a polymer containing an oxazoline group as obtained by polymerizing a monomer component which comprises an addition-polymerizable oxazoline and, if necessary, further comprises a monomer copolymerizable therewith. Examples of the addition-polymerizable oxazoline include 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-4-ethyl-2-oxazoline, 2-isopropenyl-5-methyl-2-oxazoline, 2-isopropenyl-5-ethyl-2-oxazoline, and 2-isopropenyl-4,5-dimethyl-2-oxazoline. These may be used either alone respectively or in combinations with each other. A preferable one among them is 2-isopropenyl-2-oxazoline, because it is industrially easily available.

The amount of the addition-polymerizable oxazoline, as used, is not especially limited, but is preferably 5 weight % or larger, more preferably in the range of 30~60 weight %, of the entire monomer component. In the case where the amount is smaller than 5 weight %, the extent of the curing is insufficient. In the case where the amount exceeds 60 weight %, it will have a bad effect on the water resistance.

Examples of the monomer copolymerizable with the addition-polymerizable oxazoline include: (meth)acrylic esters, such as methyl (meth)acrylate, butyl (meth)acrylate, 2-ethylhexyl (meth)acrylate, methoxypolyethylene glycol (meth)acrylate, polyethylene glycol mono(meth)acrylate, 2-hydroxyethyl (meth)acrylate, and 2-aminoethyl (meth) acrylate and its salts; unsaturated nitriles, such as (meth) acrylonitrile; unsaturated amides, such as (meth)acrylamide, N-ethylol(meth)acrylamide, and N-(2-hydroxyethyl)(meth) acrylamide; vinyl esters, such as vinyl acetate and vinyl propionate; vinyl ethers, such as methyl vinyl ether and ethyl vinyl ether; $\alpha$-olefins, such as ethylene and propylene; halogen-containing $\alpha,\beta$-unsaturated monomers, such as vinyl chloride, vinylidene chloride, and vinyl fluoride; and $\alpha,\beta$-unsaturated aromatic monomers, such as styrene, $\alpha$-methylstyrene, and sodium styrenesulfonate. These may be used either alone respectively or in combinations with each other.

To obtain the water-soluble polymer, the ratio of the hydrophilic monomer to the entire monomer component to be polymerized is preferably 50 weight % or higher, particularly preferably in the range of 60~90 weight %. Examples of the hydrophilic monomer include addition-polymerizable oxazolines, 2-hydroxyethyl (meth)acrylate, methoxypolyethylene glycol (meth)acrylate, polyethylene glycol mono(meth)acrylate, and 2-aminoethyl (meth) acrylate and its salts, and further, sodium (meth)acrylate, ammonium (meth)acrylate, (meth)acrylonitrile, (meth) acrylamide, N-methylol(meth)acrylamide, N-(2-hydroxyethyl)(meth)acrylamide, and sodium styrenesulfonate, as are selected from among the aforementioned monomer components.

The aqueous polymer having a carboxyl group is contained in the first coating agent in the ratio of preferably 5~95 weight %, more preferably 10~90 weight %, still more preferably 50~90 weight %, in terms of solid content, to the entire weight of the first coating agent. The water-soluble polymer having an oxazoline group, as used as the crosslinking agent, is contained in the first coating agent in the ratio of preferably 5~95 weight %, more preferably 10~90 weight %, still more preferably 10~50 weight %, in terms of solid content, to the entire weight of the first coating agent.

The first coating agent may further comprise components other than the aqueous polymer having a carboxyl group and the water-soluble polymer having an oxazoline group as the crosslinking agent, if necessary. Examples of such other components include: curing catalysts, such as paratoluenesulfonic acid (PTSA); organic or inorganic fine particles; dye mordants; pigments; dispersants; and ultraviolet absorbing agents.

The second coating agent, according to the present invention, comprises a polymer and a crosslinking agent, wherein the polymer has both a structural unit, as formed by ring-opening polymerization of an oxazoline compound, and a carboxyl group. Incidentally, this "polymer having both a structural unit, as formed by ring-opening polymerization of an oxazoline compound, and a carboxyl group" is mentioned in detail above.

Examples of the crosslinking agent, as used for the second coating agent, include the water-soluble polymer having an oxazoline group as mentioned in detail above, and further, melamine, aziridine, isocyanate, and epoxy.

The polymer having both a structural unit, as formed by ring-opening polymerization of an oxazoline compound, and a carboxyl group is contained in the second coating agent in the ratio of preferably 5~95 weight %, more preferably 10~90 weight %, still more preferably 50~90 weight %, in terms of solid content, to the entire weight of the second coating agent. The crosslinking agent is contained in the second coating agent in the ratio of preferably 5~95 weight %, more preferably 10~90 weight %, still more preferably 10~50 weight %, in terms of solid content, to the entire weight of the second coating agent.

The second coating agent may further comprise components other than the polymer having both a structural unit, as formed by ring-opening polymerization of an oxazoline compound, and a carboxyl group and the crosslinking agent, if necessary. Examples of such other components include: curing catalysts, such as paratoluenesulfonic acid (PTSA); organic or inorganic fine particles; dye mordants; pigments; dispersants; and ultraviolet absorbing agents.

The ink jet recording material, according to the present invention, has on at least one face thereof a coated and cured layer of the present invention first coating agent and/or a coated and cured layer of the present invention second coating agent.

The ink jet recording material is a sheet-shaped material as used to record images thereon with ink jet recording apparatuses. Examples of such ink jet recording materials include: paper, synthetic paper such as Tyvek (made by E.I. Du Pont DE NEMOURS & Co., Ltd.); cloths, such as canvas, clothing fabrics and non-woven composites; films or sheets of plastics such as polyvinyl chloride, polypropylene, and polyethylene terephthalate (PET).

The amount of the present invention first or second coating agent, as coated, is preferably in the range of 3~50 g, more preferably 5~40 g, per square meter. In the case where the amount is smaller than 3 g, water cannot sufficiently be absorbed from ink. In the case where the amount exceeds 50 g, much time and energy are necessary for drying the sheet. In addition, the coating thickness is preferably in the range of 1~50 $\mu$m, more preferably 5~40 $\mu$m. In the case where the coating thickness is less than 1 $\mu$m, water cannot sufficiently be absorbed from ink. In the case where the coating thickness exceeds 50 $\mu$m, the improvement of the ink absorbency cannot be expected very much, so there are economical disadvantages.

The curing temperature is preferably in the range of 50~200° C., more preferably 80~150° C. The curing time depends on the curing temperature, but is preferably in the range of 1~60 minutes, more preferably 1~30 minutes.

(Effects and Advantages of the Invention):

Coating an ink jet recording material with the present invention coating agent for ink jet recording materials can give an ink jet recording material which displays sufficient water resistance and further, excellent definition of initial images.

DETAILED DESCRIPTION OF THE PREFERRED EMBODIMENTS

Hereinafter, the present invention is more specifically illustrated by the following examples of some preferred embodiments in comparison with comparative examples not according to the invention. However, the invention is not limited to the below-mentioned examples. In addition, in the examples, unless otherwise noted, the units "%" and "part (s)" denote those by weight.

<Synthesis of FX-AA as an Aqueous Polymer having a Carboxyl Group and further a Structural Unit of General Formula (1)>

A mixture of 297 g of 2-ethyl-2-oxazoline, 9.2 g of chloromethylstyrene (mixture of m- and p-isomers) and 252.4 g of ethanol was charged into a 1-liter autoclave, and then heated at 130° C. for 4 hours, thus obtaining an ethanol solution of poly(2-ethyl-2-oxazoline) macromonomer with a styrene functional group at a polymerization-initiating terminal. Then, 43.2 g of acrylic acid, 3.5 g of 2,2'-azobis (isobutyronitrile) and 50 g of ethanol were added to this ethanol solution, and the resultant mixture was heated within the range of 105 to 135° C. for 6 hours. The reaction mixture was cooled, thus obtaining an ethanol solution of a poly(2-ethyl-2-oxazoline) macromonomer/acrylic acid copolymer (655.3 g of FX-AA; solid content=59.6 weight %).

<Synthesis of Water-soluble Polymer (A) having an Oxazoline Group as a Crosslinking Agent>

A mixture of 29 parts of deionized water and 1 part of V-50 (polymerization initiator made by Wako Pure Chemical Industries, Ltd.: 2,2'-azobis(2-amidinopropane) dihydrochloride) were charged into a flask having a stirrer, a reflux condenser, a nitrogen-introducing tube, a dropping funnel, and a thermometer, and then heated to 60° C. under a slow nitrogen gas current. Thereto, a monomer mixture was added from the dropping funnel over a period of 1 hour, with this monomer mixture having been prepared beforehand and comprising 0.4 parts of ethyl acrylate, 5.6 parts of methyl methacrylate, 4 parts of methoxypolyethylene glycol methacrylate (NK Ester AM-90G made by Shin-Nakamura Chemical Industrial Co., Ltd.), and 10 parts of 2-isopropenyl-2-oxazoline. During the reaction, nitrogen gas was continuously run, and the temperature in the flask was kept at 60±1° C. After the end of the addition, the same temperature was maintained for 9 hours, and then the mixture was cooled, thus obtaining an aqueous solution of a polymer (water-soluble polymer (A)) containing a 2-oxazoline group, of which the nonvolatile content was 40%, and the pH was 8.3.

EXAMPLES A~S

Aqueous solutions (coating agents) A~S with compositions of Tables 1 and 2 were prepared.

The coating agents A~S were coated, using a No. 32 bar coater, onto respective transparent PET sheets of A4 size as acid-etched with trichloroacetic acid. The sheets were then dried and cured, by hanging them for 2 minutes in a forced air oven as kept within the temperature range of 115~120° C., thus obtaining ink jet recording materials A~S. These coatings were expected to be similar in coating weight to commercially produced sheets, and the curing conditions are also similar to those used commercially.

Printing with a Bubble Jet Color Printer BJ-620 (made by Canon Inc.) was carried out onto the ink jet recording materials (coated PET films) A~S as obtained in the above way. In this printing, no attempt was made to fix the images. As to the resultant printed sheets, their definition of initial images (printing performance, print quality) was evaluated. In addition, the printed PET films were placed under running water to also evaluate the water resistance. The reason why the Bubble Jet Color Printer BJ-620 (made by Canon Inc.) was chosen for the imaging treatment is because this printer exhibits the relatively high quality of its images for image quality evaluations and further the relatively fast printing speed. Of course, in the present invention, the printer is not limited thereto, and other printers may also be used. It is to be reasonably expected that the results would be the same even if other printers were used.

As to the aqueous polymer having a carboxyl group, besides the above-synthesized FX-AA, the following materials were also used: KM-618, which is a polyvinyl alcohol containing a carboxyl group, made by Kuraray Co., Ltd.; ES-225, which is a methyl vinyl ether-maleic anhydride copolymer, made by ISP; ACP-1005, which is a vinylpyrrolidone/acrylic acid (25/75 in molar ratio) copolymer, made by ISP; Arolon 482, which is an acrylic ester copolymer, made by Nippon Shokubai Co., Ltd. Furthermore, Aquazol 500, which is a 2-ethyloxazoline homopolymer, made by Polymer Coating Innovations of Tucson, Ariz., was used. These were chosen because they are all imaged well in the printer, and are all used commercially to produce ink jet imaging materials. Incidentally, as to the FX-AA, a dilution thereof with an equal weight of ethanol was used as Sol F. In addition, the KM-618 was used as an aqueous solution (10% 618) comprising 10 g of KM-618 and 90 g of water.

As to the crosslinking agent, besides the above-synthesized water-soluble polymer (A) having an oxazoline group, the following were also used: a melamine-formaldehyde functional crosslinking agent (Cymel 301 made by Cytec), an aziridine functional crosslinking agent (1-tris(3-(methyl 3-(propylenimino)propionate)propane or PFAZ-322 made by Sybron), and an epoxy functional crosslinking agent (sorbitolpolyglycidyl ether or CR-5L made by DIC).

The evaluation results of the coating agents A~S are shown in Table 1.

TABLE 1

| Coating agent | Water-soluble polymer Sort | Water-soluble polymer Amount | Crosslinking agent Sort | Crosslinking agent Amount | Catalyst Sort | Catalyst Amount | Definition of initial image | Water resistance |
|---|---|---|---|---|---|---|---|---|
| A | PVA-COOH (10% 618) | 1.5 g | None | — | None | — | ○ | X |
| B | PVA-COOH (10% 618) | 1.5 g | Melamine (Cymel 301) | 0.3 g | PTSA | 0.1 g | X | ○ |
| C | PVA-COOH (10% 618) | 1.5 g | Aziridine (Sybron PFAZ-322) | 0.3 g | PTSA | 0.05 g | X | ○ |
| D | PVA-COOH (10% 618) | 1.5 g | Epoxy (DIC CR-5L) | 0.3 g | PTSA | 0.05 g | X | ○ |
| E | PVA-COOH (10% 618) | 1.5 g | Water-soluble polymer (A) | 0.2 g | PTSA (pH adjusted to 8.0 with $NH_3$) | 0.1 g | ○ | Δ |
| F | PVA-COOH (10% 618) | 1.5 g | Water-soluble polymer (A) | 0.6 g | PTSA (pH adjusted to 8.0 with $NH_3$) | 0.1 g | ○ | ○ |
| G | P(MVE-MAN) | 2.4 g | None | — | None | — | X | ○ |
| H | P(MVE-MAN) | 2.5 g | Water-soluble polymer (A) | 14.2 g | None | — | ○ | ○ |
| I | P(VP-AA) | 5 g | None | — | None | — | — | — |
| J | P(VP-AA) | 5 g | Water-soluble polymer (A) | 11.6 g | None | — | Δ | ○ |
| K | Arolon 482 | 8.2 g | None | — | None | — | X | ○ |
| L | Arolon 482 | 8.2 g | Water-soluble polymer (A) | 1.6 g | None | — | Δ | ○ |

*: The gram numbers show components' amounts in terms of solid content.
*: The symbols "○", "Δ", and "X" simply show results of evaluation. Refer to the below-mentioned literal results for details.
PVA-COOH: polyvinyl alcohol containing a carboxyl group (KM-618 made by Kuraray Co., Ltd.)
P(MVE-MAN): methyl vinyl ether-maleic anhydride copolymer (ES-225 made by ISP)
P(VP-AA): vinylpyrrolidone (25)/acrylic acid (75) copolymer (ACP-1005 made by ISP)
Arolon 482: acrylic ester copolymer (Arolon 482 made by Nippon Shokubai Co., Ltd.)
PTSA: paratoluenesulfonic acid

TABLE 2

| Coating agent | Water-soluble polymer Sort | Water-soluble polymer Amount | Crosslinking agent Sort | Crosslinking agent Amount | Catalyst Sort | Catalyst Amount | Definition of initial image | Water resistance |
|---|---|---|---|---|---|---|---|---|
| M | PEOX (Aquazol 500) | 10 g | None | — | None | — | ○ | X |
| N | FX-AA (Sol F) | 32.5 g | None | — | None | — | ○ | X |
| O | FX-AA (Sol F) | 4.875 g | Melamine (Cymel 301) | 0.9 g | PTSA | 0.3 g | Δ | ○ |
| P | FX-AA (Sol F) | 4.875 g | Aziridine (Sybron PFAZ-322) | 0.9 g | PTSA | 0.05 g | X | ○ |

TABLE 2-continued

| Coating agent | Water-soluble polymer Sort | Water-soluble polymer Amount | Crosslinking agent Sort | Crosslinking agent Amount | Catalyst Sort | Catalyst Amount | Definition of initial image | Water resistance |
|---|---|---|---|---|---|---|---|---|
| Q | FX-AA (Sol F) | 4.875 g | Epoxy (DIC CR-5L) | 0.9 g | PTSA | 0.05 g | X | ○ |
| R | FX-AA (Sol F)) | 4.875 g | Water-soluble polymer (A) | 0.2 g | PTSA (pH adjusted to 8.0 with $NH_3$) | 0.3 g | ○ | Δ |
| S | FX-AA (Sol F)) | 4.875 g | Water-soluble polymer (A) | 0.6 g | PTSA (pH adjusted to 8.0 with $NH_3$) | 0.4 g | ○ | ○ |

*: The gram numbers show components' amounts in terms of solid content.
*: The symbols "○", "Δ", and "X" simply show results of evaluation. Refer to the below-mentioned literal results for details.
PEOX: poly(2-ethyloxazoline) (Aquazol 500 made by Polymer Coating Innovations of Tucson)
PTSA: paratoluenesulfonic acid Results of Examples A~L were as follows:

A: Imaged perfectly, but had no resistance to water.

B: Totally water resistant, but image would not dry, and beaded on surface.

C: Water resistant, but imaged imperfectly

D: Water resistant, but imaged imperfectly

E: Imaged perfectly, and had some water resistance.

F: Imaged perfectly, and totally water resistant.

G: Water resistant, but imaged imperfectly

H: Imaged perfectly, and water resistant.

I: Coating impossible.

J: Imaged somewhat poorly, but good water resistance.

K: Water resistant, but imaged poorly because of poor absorption of ink.

L: Imaged somewhat poorly, but excellent water resistance.

As is evident from these results, when the crosslinking agent was used, the improvements both in the water resistance and the image quality were seen (Examples B, C, D, E, F, H, J, and L). In Examples F and H where the water-soluble polymer (A) was used, further sufficient image quality and water resistance were seen. Therefore, the superiority, as the crosslinking agent, of the water-soluble polymer having an oxazoline group was seen.

Results of Examples M~S were as follows:

M: Imaged perfectly, but had no water resistance.

N: Imaged perfectly, but had no water resistance.

O: Totally water resistant, imaged poorly, but better than B.

P: Water resistant, but imaged imperfectly

Q: Water resistant, but imaged imperfectly

R: Imaged perfectly, showed some water resistance.

S: Imaged perfectly, coating totally water-insoluble, but lost adhesion.

The superiority of FX-AA over the 2-ethyloxazoline homopolymer would be understood from the comparison of Examples M~S, because the FX-AA is crosslinkable. Furthermore, the superiority of the water-soluble polymer (A) having an oxazoline group over the melamine-formaldehyde crosslinking agent would also be understood.

The above results of the examples clearly demonstrate the validity of the following two hypothesis. First, that the water-soluble polymer having an oxazoline group is superior to other crosslinking agents for ink jet imaging applications, because it does not destroy the imaging properties of the coating materials when it is used to improve the water resistance. Second, that the aqueous polymer having both a structural unit, as formed by ring-opening polymerization of an oxazoline compound, and a carboxyl group is superior to the homopolymer (having no carboxyl group) of the oxazoline compound, because it could be crosslinked to impart the water resistance to the ink jet recording material, while retaining its flatness, and other advantages.

Among the above Examples A~S, examples of preferred embodiments of the first coating agent according to the present invention are Examples E, F, H, J, L, R, and S, and examples of preferred embodiments of the second coating agent according to the present invention are Examples O, P, Q, R, and S.

Various details of the invention may be changed without departing from its spirit not its scope. Furthermore, the foregoing description of the preferred embodiments according to the present invention is provided for the purpose of illustration only, and not for the purpose of limiting the invention as defined by the appended claims and their equivalents.

What is claimed is:

1. A coated ink jet recording sheet material wherein the coating comprises: a water-soluble polymer having a plurality of carboxyl groups in a range of 30.1 to 95 weight % in terms of solid content of a weight of the coating; and a water-soluble polymer having an oxazoline group as a crosslinking agent "wherein the water-soluble polymer is a water-soluble polymer having a structural unit formed by ring-opening polymerization of an oxazoline compound which is an addition polymer of an ethylenically unsaturated carboxylic acid monomer and an ethylenically unsaturated monomer resulting from the ring-opening polymerization of an oxazoline".

2. A coated ink jet recording sheet material according to claim 1, wherein the water-soluble polymer has a structural unit of formula (1) below:

(1)

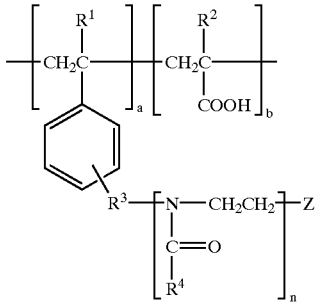

wherein: each of $R^1$ and $R^2$, independently of each other, denotes a hydrogen atom or methyl group;

$R^3$ denotes a divalent organic residue;

$R^4$ denotes a monovalent organic residue;

Z denotes a halogen atom;

a denotes an integer of 1~1,000;

b denotes an integer of 3~10,000; and n denotes an integer of 3~5,000.

* * * * *